United States Patent [19]

Hall et al.

[11] 4,145,275

[45] Mar. 20, 1979

[54] DILCHILL DEWAXING USING WASH FILTRATE SOLVENT DILUTION

[75] Inventors: Ralph R. Hall, Morristown, N.J.; David H. Shaw, Sarnia, Canada

[73] Assignee: Exxon Research & Engineering Co., Florham Park, N.J.

[21] Appl. No.: 813,174

[22] Filed: Jul. 5, 1977

Related U.S. Application Data

[63] Continuation of Ser. No. 646,006, Jan. 2, 1976, abandoned.

[51] Int. Cl.[2] ..... C10G 43/08

[52] U.S. Cl. ..... 208/33; 208/38

[58] Field of Search ..... 208/31, 33, 38

[56] References Cited

U.S. PATENT DOCUMENTS

| | | | |
|---|---|---|---|
| 2,446,514 | 8/1948 | Stewart et al. | 208/33 |
| 3,083,154 | 3/1963 | Gersic et al. | 208/33 |
| 3,458,431 | 7/1969 | Nixon | 208/33 |
| 3,644,195 | 2/1972 | Gudelis et al. | 208/33 |
| 3,775,288 | 11/1973 | Eagen et al. | 208/38 |

*Primary Examiner*—Herbert Levine

*Attorney, Agent, or Firm*—Edward M. Corcoran

[57] ABSTRACT

An improved dilution chilling dewaxing process for waxy petroleum oils wherein the dewaxed oil yield is increased and the solvent recovery requirements are decreased by recycling solvent-rich wash filtrate from the first stage wax filters back into the dilution chilling dewaxing zone.

8 Claims, 1 Drawing Figure

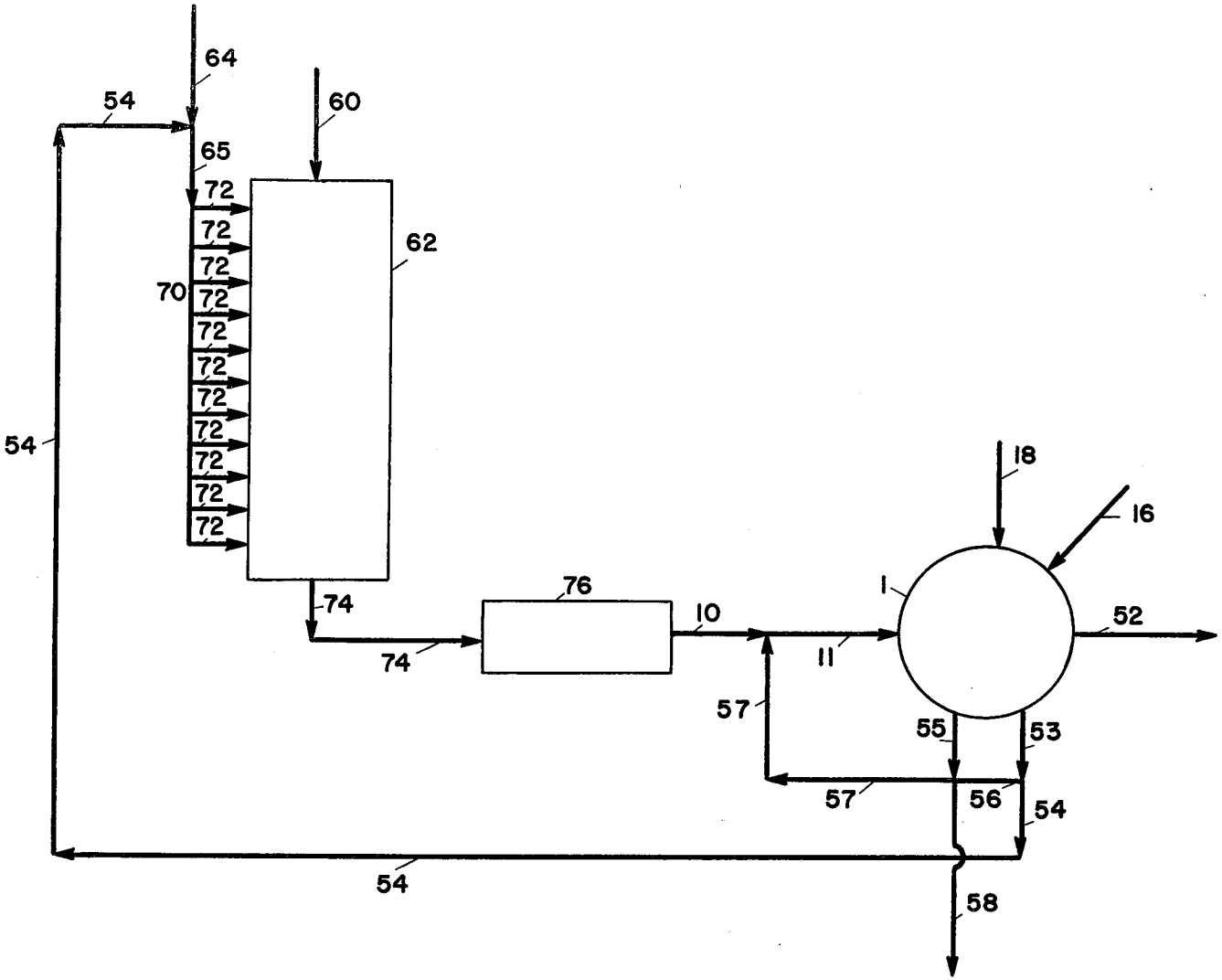
16
18
52
53
54
55
56
58
1
11
57
57
10
76
74
74
62
60
64
65
72
70
54
54
54

DILCHILL DEWAXING USING WASH FILTRATE SOLVENT DILUTION

This is a continuation, of application Ser. No. 646,006, filed Jan. 2, 1976 now abandoned.

BACKGROUND OF THE INVENTION

1. Field of the Invention

This invention relates to a process for solvent dewaxing waxy petroleum oil stocks. More particularly this invention relates to an improved dilution chilling solvent dewaxing process wherein solvent-rich wash filtrate from first stage wax filtration is recycled back into the dilution chilling dewaxing zone thereby reducing solvent recovery requirements and at the same time increasing dewaxed oil yields.

2. Description of the Prior Art

It is well known in the art to dewax waxy petroleum oil stocks by processes which include diluting the waxy stock with a solvent and cooling the oil-solvent mixture to precipitate out the wax, thereby forming a slurry comprising solid wax particles, solvent and dewaxed oil. The wax is then separated from the dewaxed oil and solvent by various filtration methods, the most common of which is rotary vacuum filtration.

There are many different and well known processes for precipitating wax from waxy petroleum oil stocks, one of which involves cooling an oil/solvent solution in a scraped surface heat exchanger. In this particular type of process, waxy oil and solvent, at approximately the same temperature, are mixed in such a manner so as to effect complete and thorough solution of the oil in the solvent before being cooled or chilled. This solution is then cooled at a uniform, slow rate under conditions which avoid agitation of the solution as the wax precipitates out. Some of the disadvantages of this process include loss of capacity via loss of cooling and heat transfer rate due to deposition of the wax on the surfaces of the exchangers and poor filtration rates due to mashing of the wax crystals by the scrapers. Another well known method of solvent dewaxing petroleum oil stocks involves conventional, incremental solvent addition. In this method, solvent is added to the oil at several points along a chilling apparatus. However, the waxy oil is first chilled without solvent until some wax crystallization has occurred and the mixture has thickened considerably. A first increment of solvent is introduced at this point in order to maintain fluidity, cooling continues and more wax is precipitated. A second increment of solvent is added to maintain fluidity. This process is repeated until the desired oil-wax filtration temperature is reached, at which point an additional amount of solvent is added in order to reduce the viscosity of the mixture to that desired for the filtration step. In this method the temperature of the incrementally added solvent should also be about the same as that of the wax/oil/solvent mixture. If the solvent is introduced at a lower temperature, shock chilling of the slurry occurs resulting in the formation of small and/or acicula shaped wax crystals with attendant poor filter rate.

It is well known that the adverse shock chilling effect caused by the incremental addition of cold dewaxing solvent can be overcome by introducing the waxy oil into an elongated, staged cooling zone or tower at a temperature above its cloud point and incrementally introducing a cold dewaxing solvent into said zone, along a plurality of points or stages therein, while maintaining a high degree of agitation so as to effect substantially instantaneous mixing of the solvent and wax/oil mixture as they progress through said zone. The basic concept is shown in U.S. Pat. No. 3,773,650, the disclosures of which are incorporated herein by reference and shall hereinafter be referred to as dilution chilling. A number of improvements have been made to the basic concept of the dilution chilling dewaxing process, such as that shown in U.S. Pat. No. 3,681,230 wherein the waxy oil and solvent are miscible until the temperature reaches the wax/oil separation temperature, at which point bulk immiscibility occurs between the oil and solvent. This generally happens near the last stage of the cooling zone and results in superior filter rates when the waxy oil being fed to the tower is relatively high in viscosity and molecular weight. U.S. Pat. No. 3,850,740 shows that dilution chilling may be advantageously used with relatively heavy, resid-containing waxy petroleum oil stocks, by partially prediluting the waxy oil before it is introduced into the dilution chilling zone.

As hereinbefore mentioned, in all of the various solvent dewaxing processes it is ultimately necessary to separate the wax from the dewaxed oil and this is done by various filtration methods, the most common of which is rotary vacuum filtration. Further, more than one stage of filtration is often used, with the wax from the first stage being repuddled or slurried with additional solvent and sent to a second stage for additional filtration. It is necessary at least for the wax cake formed in the first stage to be washed with solvent in order to remove excess oil trapped in the cake to form a solvent-rich wash filtrate. This wash filtrate contains some oil and, in the past, has been recovered either separately or by combining same with the dewaxed oil filtrate, heating up the combined filtrates and then flash evaporating, distilling, stripping, etc., to separate the solvent from the oil, cooling the solvent back down to the filter or dewaxing temperature and recycling same back to the dewaxing zone or to the filter for washing the wax cake.

An attempt to recycle the wash filtrate directly back to the solvent dewaxing zone was made over 30 years ago in a conventional incremental dilution dewaxing process wherein the filtrate entering the cooling zone was heated up to the oil temperature before being mixed with the waxy oil. However, this was not successful using ketone solvents because the recycled filtrate contained oil, the presence of which resulted in poor wax crystals and too much oil occluded in the wax, thereby lowering both the filtrate rate and dewaxed oil yield. The debits resulting from this process more than offset the advantage that was gained in avoiding repurifying the wash solvent. More recently, recycling the wash filtrate to the dewaxing zone was disclosed in an article titled "German Unit Gives Dewaxing Data," which appeared in the September 1963 issue of HYDROCARBON PROCESSING AND PETROLEUM REFINER (volume 42, No. 12, pages 104–106), wherein both the dewaxing and wash solvents were a mixture of dichloroethylene and methylene chloride, also known as the DI-ME process. However, in this process too the wash filtrate has to be heated up to the temperature of the waxy oil before it is introduced into the dewaxing zone.

Therefore, it would be a considerable improvement to the art if, in a dilution chilling dewaxing process, a substantial portion of the wash filtrate from the first stage of filtration could be recycled directly back into the dewaxing zone without having to first remove the oil therefrom and/or heat it up as has heretofore been required in the processes disclosed in the prior art.

SUMMARY OF THE INVENTION

Accordingly, therefore, it has now been found that in a dewaxing process wherein a waxy petroleum oil feed is introduced into a dilution chilling dewaxing zone to produce a slurry comprising solid wax particles and a dewaxed oil containing solvent and wherein said slurry is passed from said zone to a first filter stage to separate the wax from the dewaxed oil and wherein the wax is solvent washed in said stage thereby forming a wash filtrate, the improvement which comprises recycling a substantial portion of said wash filtrate directly back into the dewaxing zone as part of the dewaxing solvent in an amount such that the dewaxing solvent entering said zone contains less than about 9 LV% (liquid volume) oil. The essence of the invention lies in the discovery that keeping the oil content of dewaxing solvent entering the dilution chilling dewaxing zone below about 9 LV% avoids any increase in the liquid/solids ratio of the wax cake. If the oil content of the dewaxing solvent exceeds about 9 LV%, then a wetter wax cake results. It has further been discovered that using the instant invention in conjunction with recycling oily filtrate from the first filtration stage back to said stage results in increased dewaxed oil yields and a more oil-free wax cake. Also, the recycled wash filtrate that is the essence of this invention must come from the first filtration stage if more than one stage of filtration is employed in the dewaxing process.

Essential to the operation of the instant invention is the requirement that the dilution chilling dewaxing zone and process for precipitating wax from the waxy oil must be similar to that disclosed in U.S. Pat. No. 3,773,650 and may include various improvements and modifications as heretofore described under Description of the Prior Art, supra.

By substantial portion of the wash filtrate is meant from at least about 25 LV% to about 100 LV% and preferably about 50 LV%. As is well known in the art, when wax is precipitated from a waxy oil to form a waxy slurry comprising solid wax, dewaxed oil and solvent, the slurry is filtered to separate the wax from the dewaxed oil and solvent, thereby forming a wax cake containing small amounts of oil as well as an oily filtrate. The oily filtrate contains the desired dewaxed oil and dewaxing solvent. The wax cake is washed, in the filter, with fresh solvent in order to remove the oil therefrom, thereby forming a wash filter which comprises the wash solvent and the oil displaced and dissolved from the wax cake. The oil content of the wash filtrate can range from about 2 LV% to 20 LV% and depends on a number of variables such as the oily feed being dewaxed, composition, amount and temperature of wash solvent used, etc. Therefore, depending on the oil content of the wash filtrate, about 25 LV% to 100 LV% of said filtrate is fed back to the dewaxing zone where it is mixed with fresh dewaxing solvent and/or with recycled second stage filtrate if two stages of filtration are used prior to entering said zone, in an amount such that the oil content of the total or mixed dewaxing solvent is less than about 9 LV%. The rest of the wash filtrate is combined with the oily filtrate.

The combined filtrate is sent to solvent and oil recovery and, additionally, may also be recycled back to filtration wherein it is combined with the waxy slurry being fed to the wax filters. Typically, the combined filtrate recycle ranges from 0 LV% to 300 LV% of the oily feed entering the dewaxing zone. This does not mean that the combined filtrate is first recycled and then sent to oil and solvent recovery. Initially, during startup of the dewaxing operation, a portion of the combined filtrate that would normally be sent to oil and solvent recovery is instead diverted to the recycle loop to build up the volume of filtrate required to operate same. Once the combined filtrate recycle loop contains the required volume of filtrate and has reached a continuous, steady state condition, although some of the combined filtrate from the first stage of filtration will continue to be diverted to recycle, it is no longer at the expense of the volumetric flow rate of same to the oil and solvent separation and recovery operations.

Any suitable means known in the art for separating wax from the slurry, such as filtration or centrifugation, may be employed in the process of the instant invention. Preferred means include continuous rotary drum vacuum or pressure filtration. Continuous rotary drum filters are well known and used in the petroleum industry for wax filtration and models specifically designed and constructed for filtering wax from lube oil fractions are commercially available from manufacturers such as Dorr Oliver and Eimco. A typical rotary drum vacuum filter comprises a horizontal, cylindrical drum, the lower portion of which is immersed in a trough containing the wax slurry, a filter medium or cloth covering the horizontal surface of the drum, means for applying both vacuum and pressure thereto and means for washing and removing wax cake deposited on the cloth as the drum continuously rotates around its horizontal axis. In these filters the drum is divided into compartments or sections, each section being connected to a rotary (trunnion) valve and then to a discharge head. The wax slurry is fed into the filter trough and as the drum rotates, the faces of the sections pass successively through the slurry. In a vacuum drum filter, a vacuum is applied to the sections as they pass through the slurry, thereby drawing oily filtrate through the filter medium and depositing wax therein in the form of a cake. As the cake leaves the slurry it contains only filtrate which is removed therefrom by the continued application of vacuum, along with wash solvent which is evenly distributed or sprayed on the surface of the cake, thereby forming a solvent-rich wash filtrate. Finally, the washed wax cake is removed by a scraper which is assisted by means of blow gas applied to each section of the drum as it rotates and reaches the scraper. In a pressure filter, the solvent contains an autorefrigerant, which, by virtue of its relatively high vapor pressure, is sufficient to apply a pressure differential across the filter surface of the drum, thereby eliminating the need for applying a vacuum thereto. By making appropriate adjustments to the trunnion valve, the wash filtrate may be collected separately from the oily filtrate.

Any solvent useful for dewaxing waxy petroleum oils may be used in the process of this invention. Representative examples of such solvents are (a) the aliphatic ketones having from 3 to 6 carbon atoms, such as acetone, methyl ethyl ketone (MEK) and methyl isobutyl ketone (MIBK), and (b) lower molecular weight autorefrigerant hydrocarbons, such as ethane, propane, butane and propylene, as well as mixtures of the foregoing and mixtures of the aforesaid ketones and/or hydrocarbons with aromatics such as benzene, xylene and toluene. In addition, halogenated, low molecular weight hydrocarbons such as the $C_2$–$C_4$ chlorinated hydrocarbons, e.g., dichloromethane, methane, dichloroethane, methylene chloride and mixtures thereof, may be used as solvents either alone or in admixture with any of the forementioned solvents. Another solvent that may be used in admixture with any of the other solvents is N-methyl-2-pyrrolidone (NMP).

Specific examples of suitable solvents include mixtures of MEK and MIBK, MEK and toluene, dichloromethane and dichloroethane, propylene and acetone. Preferred solvents are ketones. Particularly preferred solvents include mixtures of MEK and MIBK and MEK and toluene.

Typically, filtration temperatures for the waxy slurries range from about −30° F. to +25° F. for ketone solvents and from about −45° F. to −25° F. for autorefrigerant solvents such as propane and propylene/acetone. The wash solvent is usually at or slightly above the filtration temperature.

Any waxy petroleum oil stock or distillate fraction thereof may be dewaxed employing the improvement of this invention. Illustrative, but nonlimiting examples of such stocks are (a) distillate fractions that have a boiling range within the broad range of about 500° F. to about 1300° F., with preferred stocks including the lubricating oil and specialty oil fractions boiling within the range of between about 550° F. and 1200° F., (b) bright stocks and deasphalted resids having an initial boiling point above about 800° F. and (c) broad cut feed stocks that are produced by topping or distilling the lightest material off a crude oil leaving a broad cut oil, the major portion of which boils above about 500° F. or 650° F. Additionally, any of these feeds may be hydrocracked prior to distilling, dewaxing or topping. The distillate fractions may come from any source such as the paraffinic crudes obtained from Aramco, Kuwait, the Pan Handle, North Louisiana, etc., naphthenic crudes, such as Tia Juana, Coastal crudes, etc., as well as the relatively heavy feed stocks, such as bright stocks having a boiling range of 1050+° F. and synthetic feed stocks derived from Athabasca Tar Sands, etc.

BRIEF DESCRIPTION OF THE DRAWING

The attached drawing is a flow diagram of a preferred embodiment of a process incorporating the improvement of the instant invention.

DETAILED DESCRIPTION

Referring to the drawing, a waxy petroleum oil stock above its cloud point enters dilution chilling zone 62 via line 60. At the same time, cold dewaxing solvent is fed into zone 62 via lines 64 and 65, manifold 70 and multiple solvent injection points 72. The rate of solvent flow through each inlet or injection point is regulated by means (not shown) so as to maintain a desired temperature gradient along the length of dilution chilling zone 62. The first portion or increment of cold dewaxing solvent may enter dilution chilling zone 62 at a first agitation stage (not shown) within said zone wherein said solvent is substantially instantaneously mixed with the waxy oil. Preferably, the rate of incremental solvent addition is such that the chilling rate of the oil is below about 10° F./minute and most preferably between about 1° and 5° F./minute. In general, the amount of solvent added thereto will be sufficient to provide a liquid/solid weight ratio of between about 5/1 and 100/1 at the dewaxing temperature and a solvent/oil volume ratio of between about 1/1 and 7/1.

Cooling of the waxy oil continues to a temperature substantially below its cloud point, thereby precipitating at least a portion of the wax therefrom and forming a solid wax-oil/solvent slurry. The slurry passes from dilution chilling zone 62 to scraped surface chiller 76 via line 74 wherein it is additionally cooled down to the filtration temperature with the result that more wax is precipitated from the oil. The cold slurry from scraped surface chiller 76 is then fed to rotary drum vacuum filter 1 via lines 10 and 11 wherein the wax is separated from the dewaxed oil filtrate. Blow gas fed to filter 1 via line 16 aids in removing the wax therefrom. The wax is removed from the filter via line 52. The dewaxed oil or oily filtrate is removed from the filter via line 55 and from there sent to means for separating the solvent from the oil via line 58 and/or, if desired, some of it may be combined with wash filtrate from line 56 and the combined filtrate then recycled back to the filter via lines 57 and 11. Concurrently, cold (i.e., −45° F. to +27° F.) wash solvent is fed into filter 1 via line 18 wherein it is sprayed or distributed over wax cake deposited on the rotary filter drum (not shown) to remove oily filtrate from the wax cake and form a wash filtrate. The wash filtrate is removed from the filter via line 53 with from 25 LV% to 100 LV% of it being recycled back to dewaxing zone 62 via line 54, line 65 wherein it is combined with fresh dewaxing solvent, manifold 70 and multiple injection points 72. That portion of wash filtrate not recycled back to zone 62 is combined with oily filtrate via line 56. The combined filtrate is then passed to solvent and oil recovery via line 58 and a portion of it may be recycled back to filter 1 via lines 57 and 11.

PREFERRED EMBODIMENT

The invention will be more apparent from the working examples set forth below.

EXAMPLE 1

This example is a computer simulation of the process described in the drawing, supra. A waxy lube oil feed stock containing about 20 wt.% wax is fed into a dilution chilling solvent dewaxing zone wherein it is mixed with cold dewaxing solvent comprising 40/60 LV%, MEK/MIBK at about −20° F. to precipitate a portion of the wax from the oil to form a waxy slurry. The amount of cold solvent employed in the dilution chilling zone is sufficient to produce a final liquid volume solvent/oil ratio of about 3/1 based on the oil feed to the dewaxing zone. The final temperature reached by the slurry in said zone is about 30° F. The cold slurry is then fed to a scraped surface chiller wherein it is cooled down to a filtration temperature of about 15° F., which results in additional wax being precipitated from the solvent/oil mixture. The slurry is then fed from the scraped surface chiller to a rotary drum vacuum filter to separate the wax from the solvent-containing dewaxed oil or oily filtrate. The wax cake on the rotary filter drum is washed by spraying it with cold wash solvent (40/60 LV% MEK/MIBK) at a temperature of 22° F. and at a solvent/feed ratio of 1.2/1 (based on the oil feed to the dewaxing zone), thereby forming wash filtrate. The rotary or trunnion valve on the filter is adjusted so that the first 50% of the wash filtrate, which contains most of the oil washed off the wax cake, is combined with the oily filtrate which is sent to solvent and oil recovery, with the rest of the wash filtrate (relatively oil-lean or solvent rich) is recycled back to the dilution chilling dewaxing zone where it is mixed with fresh dewaxing solvent prior to entering said zone. The recycled wash filtrate comprises about 20 wt.% of the total dewaxing solvent entering said zone. The recycled wash filtrate contains about 12 wt.% oil which results in the total dewaxing solvent containing about 2.5 wt.% oil.

The data for this simulated dewaxing process are given in Table 1 and show that the combined filtrate sent to solvent recovery will contain about 14 wt.% less solvent when the improvement of the instant invention is employed, thereby substantially decreasing solvent and oil recovery requirements. The data also show that using the improvement of the instant invention will have no adverse effect on the yield of both wax and dewaxed oil.

TABLE 1

REDUCING SOLVENT RECOVERY LOAD

| Stream Comp. parts by wt. | Without Oil | Without Wax | Without Solvent[1] | With Oil | With Wax | With Solvent[1] |
|---|---|---|---|---|---|---|
| Waxy Oil Feed | 80 | 20 | | 80 | 20 | |
| Solvent to Chilling Zone: | | | | | | |
| a) Fresh solvent | | | 300 | | | 253 |
| b) Wash filtrate[2] | | | | 8 | | 57 |
| c) Total liquid[3] | | | 300 | 8 | | 310 |
| Filter Wash Solvent | | | 120 | | | 120 |
| To recovery: | | | | | | |
| a) Wax cake | 3 | 20 | 80 | 3 | 20 | 80 |
| b) Combined filtrate | 77 | | 340 | 77 | | 293 |

[1]MEK/MIBK 40/60 LV%.
[2]Comprises 20% of total solvent to chilling zone.
[3]Contains less than 9 LV% oil.

EXAMPLE 2

This example is identical to 1 above except that about 42 LV% of the combined filtrate is recycled back to the filter.

The results of this computer simulated plant run are in Table 2 wherein it is shown that use of the improvement of the instant invention can, in a single filtration stage, give a dewaxed oil yield normally obtained only from a two-stage filtration; i.e., the wax cake will contain only about one-third as much oil and the combined oily filtrate will contain more dewaxed oil.

TABLE 2

INCREASING DEWAXED OIL YIELD

| Stream Comp. parts by wt. | Without Wash Filtrate Recycle Oil | Without Wash Filtrate Recycle Wax | Without Wash Filtrate Recycle Solvent[1] | With Wash Filtrate Recycle Oil | With Wash Filtrate Recycle Wax | With Wash Filtrate Recycle Solvent[1] |
|---|---|---|---|---|---|---|
| Waxy Oil Feed | 80 | 20 | | 80 | 20 | |
| Solvent to Chilling Zone: | | | | | | |
| a) Fresh solvent | | | 300 | | | 180 |
| b) Wash filtrate[2] | | | | 8 | | 118 |
| c) Total liquid[3] | | | 300 | 8 | | 298 |
| Combined Filtrate Recycle[4] | | | | 56 | | 244 |
| Filter Wash Solvent | | | 120 | | | 240 |
| To recovery: | | | | | | |
| a) Wax cake | 3 | 20 | 80 | 1 | 20 | 80 |
| b) Combined filtrate | 77 | | 340 | 79 | | 340 |

[1]MEK/MIBK 40/60 LV%.
[2]Comprises 41% of total solvent to chilling zone.
[3]Contains less than 9 LV% oil.
[4]This portion of the combined filrate is recycled to the outlet of the chilling zone just prior to filtration.

EXAMPLE 3

The predictions of the preceding examples are based on a constant wax cake liquids/solids ratio. The wax cake liquids/solids ratio is an important parameter for predicting the oil content of the wax cake as a function of solvent composition. This example shows the effect that the oil content in the wash filtrate recycle to the dilution chilling zone has on the liquids/solids ratio of the wax cake.

In this experiment, a laboratory simulation of a commercial dilution chilling tower was used to precipitate wax from a waxy lube oil stock using a 70/30 LV% of MEK/toluene as the dewaxing solvent. The waxy oil had a viscosity of 600 SUS at 100° F., was filtered at a temperature of +10° F. and washed with a 70/30 LV% solvent mixture of MEK/toluene to give a dewaxed oil pour point of +24° F. The wash time was approximately one-half the filter time. The data in Table 3 show that the wax cake liquids/solids ratio stayed constant until the oil content of the dilution solvent reached about 9%, at which point it substantially increased and continued to increase as the oil content increased.

TABLE 3

EFFECT OF OIL CONTENT IN WASH FILTRATE RECYCLE ON WAX CAKE LIQUID/SOLIDS RATIO

| Run No. | Wt. % Oil in Dilution Solvent[1] | Vol. Ratio of Wash Solvent To Fresh Dewaxing Feed | Wt. % Oil in Wax | Wax Cake Liquids/Solids Ratio Wt./Wt. |
|---|---|---|---|---|
| 1 | 0 | 0.45 | 19 | 3.2 |
| 2 | 3 | 0.57 | 19 | 3.5 |
| 3 | 6 | 0.78 | 14 | 3.3 |
| 4 | 9 | 0.93 | 16 | 4.0 |
| 5 | 12 | 0.94 | 16 | 4.1 |
| 6 | 15 | 1.17 | 20 | 5.4 |

[1]Solvent/oil + wax to filter = 3.0/1 Vol./Vol.

What is claimed is:

1. In a solvent dewaxing process wherein a waxy petroleum oil stock is at least partially solvent dewaxed in a dilution chilling dewaxing zone by introducing cold dewaxing solvent into said zone to produce a slurry comprising solid wax particles and a dewaxed oil containing solvent and wherein said slurry is passed from said zone to a first filter stage to separate the wax from the dewaxed oil thereby forming a wax cake and an oily filtrate and wherein the wax cake is solvent washed in said stage thereby forming a wash filtrate containing from about 2 to 20 LV% oil, the improvement which comprises (a) recycling a substantial portion of the oil-containing wash filtrate from said first filter stage directly back to the dewaxing zone where it is mixed with fresh dewaxing solvent prior to entering said dewaxing zone as part of the mixed dewaxing solvent entering said dilution chilling dewaxing zone in an amount such that the oil content of the mixed dewaxing solvent entering said zone is less than about 9 LV% and (b) combining the rest of the wash filtrate with the oily filtrate and recycling a portion of the combined filtrate back to the first filter stage wherein it enters said stage with slurry from said dewaxing zone.

2. The process of claim 1 wherein 25 LV% to 100 LV% of the wash filtrate is recycled back into the dewaxing zone.

3. The process of claim 2 wherein said filter stage comprises at least one rotary drum filter.

4. The process of claim 3 wherein the temperature of the wash solvent ranges from about −45° F. to 25° F.

5. The process of claim 3 wherein the solvent is selected from the group consisting of ketones having 3 to 6 carbon atoms and their mixtures.

6. The process of claim 3 wherein the solvent is chosen from the group consisting of low molecular weight hydrocarbons and ketones having 3 to 6 carbon atoms.

7. The process of claim 3 wherein the solvent comprises a mixture of ketones having 3 to 6 carbon atoms and at least one solvent selected from the group consisting of benzene, toluene and xylene.

8. The process of claim 3 wherein said solvent comprises N-methyl-2-pyrrolidene.

* * * * *